US007090730B2

(12) United States Patent
Nomura et al.

(10) Patent No.: US 7,090,730 B2
(45) Date of Patent: Aug. 15, 2006

(54) R-FE-B SINTERED MAGNET

(75) Inventors: Tadao Nomura, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 438 days.

(21) Appl. No.: 10/706,006

(22) Filed: Nov. 13, 2003

(65) Prior Publication Data

US 2004/0094237 A1 May 20, 2004

(30) Foreign Application Priority Data

Nov. 14, 2002 (JP) ..... 2002-330741

(51) Int. Cl.
*H01F 1/057* (2006.01)

(52) U.S. Cl. ..... 148/302; 75/230; 75/244; 75/246

(58) Field of Classification Search ..... None
See application file for complete search history.

(56) References Cited

U.S. PATENT DOCUMENTS

| | | | | |
|---|---|---|---|---|
| 4,888,068 | A | 12/1989 | Tokunaga et al. | |
| 5,352,302 | A * | 10/1994 | Takagi et al. | 148/101 |
| 2002/0112785 | A1* | 8/2002 | Sekine et al. | 148/302 |
| 2003/0019546 | A1* | 1/2003 | Kanekiyo et al. | 148/105 |
| 2006/0016515 | A1* | 1/2006 | Tomizawa et al. | 148/101 |

FOREIGN PATENT DOCUMENTS

| | | | |
|---|---|---|---|
| EP | 0344542 | A2 | 12/1989 |
| JP | 60-106108 | A | 6/1985 |
| JP | 60-159152 | A | 8/1985 |
| JP | 61-34242 | B2 | 8/1986 |
| JP | 3-19296 | B2 | 3/1991 |
| JP | 3-46963 | B2 | 7/1991 |
| JP | 4-22006 | B2 | 4/1992 |
| JP | 5-10806 | B2 | 2/1993 |
| JP | 7-78269 | B2 | 8/1995 |
| JP | 2610798 | B2 | 2/1997 |

OTHER PUBLICATIONS

Chen et al., J. of Magnetism & Magnetic Materials, vol. 162, pp. 307-313, (1996).

* cited by examiner

*Primary Examiner*—John P. Sheehan
(74) *Attorney, Agent, or Firm*—Birch, Stewart, Kolasch & Birch, LLP

(57) ABSTRACT

An R—Fe—B base sintered magnet having a composition of 12–17 at % of R (wherein R stands for at least two of yttrium and rare earth elements and essentially contains Nd and Pr), 0.1–3 at % of Si, 5–5.9 at % of B, 0–10 at % of Co, and the balance of Fe, containing a $R_2(Fe,(Co),Si)_{14}B$ intermetallic compound primary phase and at least 1% by volume of an R—Fe(Co)—Si grain boundary phase, and being free of a B-rich phase exhibits a coercive force of at least 10 kOe despite a reduced content of heavy rare earth.

5 Claims, No Drawings

R-FE-B SINTERED MAGNET

This Nonprovisional application claims priority under 35 U.S.C. § 119(a) on Patent Application No(s). 2002-330741 filed in JAPAN on Nov. 14, 2002, the entire contents of which are hereby incorporated by reference.

BACKGROUND OF THE INVENTION

1. Field of the Invention

This invention relates to R—Fe—B base sintered magnets containing silicon as additive element.

2. Background Art

Prior art R—Fe—B base sintered magnets, for example, those described in Japanese Patent Nos. 1,431,617 and 1,655,487 are utilized in a variety of applications for their excellent magnetic properties. Typically Nd and Pr are used as the rare earth R, but as such, temperature characteristics are undesirable. Then partial replacement of R by Dy or Tb is employed for increasing the coercive force at room temperature as disclosed in Japanese Patent No. 1,802,487.

R—Fe—B base sintered magnets are structured such that a hard magnetic phase of $R_2Fe_{14}B$ is present as a primary phase, and grain boundary moieties surround primary phase grains. The grain boundary moieties are composed of an R-rich phase (a phase containing 80–98 at % R) and a phase represented by the composition $R_{1+\epsilon}Fe_4B_4$ ($\epsilon$=0.1 in the event R=Nd) or $R_2Fe_7B_6$, known as B-rich phase. The structure further includes oxide, carbide and other phases which are inevitably introduced by the manufacturing process.

It is also known that various elements when added form compound phases such as $RM_2$, $R_3M$ and $R_5M_3$ wherein M is an additive element.

One of the additive elements commonly added to Nd magnets is silicon. See Japanese Patent Nos. 2,138,001, 1,683,213, 1,737,613, and 2,610,798, JP-A 60-159152 and JP-A 60-106108. In these patents, silicon is added mainly for the purposes of improving temperature characteristics or oxidation resistance.

As to the addition of Si to Nd magnets, it is known that the extent of improvement is not so great when added in trace amounts, whereas addition of 1% or more can degrade the magnetic properties such as Br and iHc.

As mentioned above, heavy rare earths are often used for increasing the coercive force. Since the heavy rare earths such as Dy and Tb are present in less reserves in the crust than light rare earths, their cost is very high as compared with Nd. The coercive force increases with the increasing amount of Dy or Tb added, but the material cost increases at the same time. As the magnet market will expand from now on, magnets containing high concentrations of Dy and Tb will become in short supply, which poses a problem.

A study is thus made on additives other than Dy and Tb as another means for increasing coercive force.

Of other additives, V, Mo, Ga and the like have been reported to have a coercive force increasing effect. However, they belong to the rare metal family and offer little advantages as the replacement for Dy.

In order that R—Fe—B base magnets adapted for high-temperature use find a large market in the future, it is requisite to have a novel method or magnet composition that can increase the coercive force while minimizing the amount of Dy added.

SUMMARY OF THE INVENTION

Therefore, an object of the invention is to provide a less expensive R—Fe—B base sintered magnet having a high coercive force.

It has been found that when an R—Fe—B base sintered magnet is given a structure that contains a $R_2(Fe,(Co),Si)_{14}B$ primary phase and a R—Fe(Co)—Si grain boundary phase and is free of a B-rich phase, the coercive force of the magnet is increased to 10 kOe or higher. Establishing conditions and the optimum composition to give the above structure, the inventors have arrived at the present invention. As used herein, (Co) means that cobalt is optional.

According to the present invention, there is provided an R—Fe—B base sintered magnet of a composition consisting essentially of, in atom percent, 12 to 17% of R which stands for at least two of yttrium and rare earth elements and essentially contains Nd and Pr, 0.1 to 3% of Si, 5 to 5.9% of B, up to 10% of Co, and the balance of Fe, containing a primary phase of $R_2(Fe,(Co),Si)_{14}B$ intermetallic compound, and having a coercive force iHc of at least 10 kOe, characterized in that the magnet is free of a B-rich phase and contains at least 1% by volume based on the entire magnet of a phase consisting essentially of, in atom percent, 25 to 35% of R, 2 to 8% of Si, up to 8% of Co, and the balance of Fe (referred to as "R—Fe(Co)—Si grain boundary phase," hereinafter). As used herein, the B-rich phase indicates a compound phase that has a higher boron concentration (atomic ratio) in its structure than the primary phase and contains R elements as part of constituent elements. An $R_{1+\epsilon}Fe_4B_4$ phase or the like corresponds to the B-rich phase.

Preferably, the sintered magnet contains an R-rich phase, and the volume percent of the R—Fe(Co)—Si grain boundary phase is higher than the volume percent of the R-rich phase. Also desirably, the sintered magnet does not contain, as the magnet structure, compound phases consisting essentially of R and Si and containing little of Fe and Co, such as $R_5Si_3$, $R_5Si_4$, and RSi (referred to as "R—Si compound phase," hereinafter). In a preferred embodiment wherein Dy and/or Tb is contained as part of R, the magnet exhibits a coercive force iHc of at least (10+5×D) kOe wherein D is the total concentration (atom percent) of Dy and Tb in the magnet.

The sintered magnet is generally prepared by the steps of sintering and optional heat treatment. The sintering and the heat treatment each involve a cooling step. The preferred cooling step is a step of cooling at a controlled rate of 0.1 to 50° C./min at least in a temperature range from 700° C. to 500° C., or a multi-stage cooling step including holding at a constant temperature for at least 30 minutes on the way of cooling whereby the R—Fe(Co)—Si grain boundary phase is formed in the magnet structure.

DESCRIPTION OF THE PREFERRED EMBODIMENT

First described is the composition of the inventive magnet. The magnet has a composition consisting essentially of, in atom percent, 12 to 17% of R, 0.1 to 3% of Si, 5 to 5.9% of B, up to 10% of Co, and the balance of Fe. R stands for at least two of yttrium and rare earth elements and essentially contains Nd and Pr. The inclusion of Nd alone leads to an inferior squareness of demagnetization curve and an insufficient coercive force, as compared with the inclusion of both Nd and Pr. On the other hand, the inclusion of Pr alone allows oxidation and heat generation to take place during the manufacturing process, imposing the difficulty of handling.

More amounts of Pr invite a substantial lowering of coercive force at high temperatures. It is preferred for the practical purpose that Nd be the majority of R and Pr account for one-half or less of R. It is also preferred for a higher coercive force that heavy rare earths such as Dy and Tb be contained as part of R.

At an R content of less than 12 at %, the coercive force iHc of the magnet becomes extremely low. An R content of more than 17 at % leads to a decline of residual magnetic flux density or remanence Br. A silicon content of less than 0.1 at % leads to insufficient iHc due to a low proportion of R—Fe(Co)—Si grain boundary phase. A silicon content of more than 3 at % leads to a decline of magnetic properties because the R—Si compound phase is left behind or the Si content of the primary phase increases. For this reason, the silicon content is desirably in a range of 0.2 to 2 at %, more desirably in a range of 0.2 to 1 at %.

At a boron content of more than 5.9 at %, no R—Fe(Co)—Si grain boundary phase is formed. At a boron content of less than 5 at %, the volume percent of the primary phase lowers, detracting from magnetic properties. In particular, the upper limit of B that is 5.9 at % is a crucial factor. If boron is contained more, then no R—Fe(Co)—Si grain boundary phase is formed as mentioned just above. Specifically, this means that a certain phase containing a high concentration of boron exists other than the primary phase, $R_2(Fe,(Co),Si)_{14}B$ phase (whose composition consists of, in atom percent, 11.76% of R, 82.35% of (Fe,(Co), Si), and 5.88% of B). Most often, a B-rich phase forms which is represented by the composition $R_{1+\epsilon}Fe_4B_4$ ($\epsilon$=0.1 in the event R=Nd) or $R_2Fe_7B_6$. The inventors have confirmed that the presence of the B-rich phase within the structure prevents formation of the R—Fe(Co)—Si grain boundary phase, failing to produce the magnet intended herein. For this reason, the boron content is limited to the range of 5 to 5.9 at %, preferably 5.1 to 5.8 at %, more preferably 5.2 to 5.7 at %.

The balance of the composition is iron, which may be partially replaced by incidental impurities which are introduced during the manufacturing process or additive elements positively added for improving magnetic properties (e.g., Al, Ti, V, Cr, Mn, Ni, Cu, Zn, Ga, Ge, Zr, Nb, Mo, In, Sn, Sb, Hf, Ta, W, Pt, Au, Hg, Pb, and Bi). The replacement amount is desirably limited to 3 at % or less so as to avoid any negative impact on magnetic properties.

For the purpose of improving the Curie temperature and corrosion resistance, not more than 10 at % of Fe may be replaced by Co. Replacement of Co in excess of 10 at % invites a substantial lowering of iHc and is thus undesirable.

The inventive magnet is desired to have as low an oxygen content as possible. However, the introduction of oxygen is inevitable due to the manufacturing process. Then an oxygen content of up to about 1 wt % is regarded acceptable. In practice, an oxygen content of up to 500 ppm is desirable. It is acceptable that other impurities such as H, C, N, F, Mg, P, S, Cl and Ca be contained up to 1,000 ppm. Of course, the content of these elements should desirably be as low as possible.

The structure of the inventive magnet has a $R_2(Fe,(Co),Si)_{14}B$ phase as the primary phase and contains at least 1% by volume of an R—Fe(Co)—Si grain boundary phase. If the content of R—Fe(Co)—Si grain boundary phase is less than 1 vol %, the magnet exhibits magnetic properties that do not reflect the effect of the grain boundary phase, and hence, fails to exhibit a fully high iHc. The content of the grain boundary phase is preferably 1 to 20 vol %, more preferably 1 to 10 vol %.

The R—Fe(Co)—Si grain boundary phase is considered to be an intermetallic compound phase having a crystalline structure I4/mcm. On quantitative analysis by such a technique as electron probe microanalysis (EPMA), the boundary phase is found to consist essentially of 25 to 35% of R, 2 to 8% of Si, 0 to 8% of Co, and the balance of Fe, expressed in atom percent inclusive of measurement errors. Then the primary phase desirably has a silicon concentration which is lower than the silicon content of the R—Fe(Co)—Si grain boundary phase and falls in the range of 0.01 to 1.5 at %.

In some embodiments wherein the magnet composition does not contain cobalt, of course, neither the primary phase nor the R—Fe(Co)—Si grain boundary phase contains cobalt.

In the magnet of the invention, the B-rich phase is not contained although other phases such as an R-rich phase, an oxide phase and a carbide phase, vacancies, and a $R_3Co$ phase, if cobalt is contained, exist along with the R—Fe(Co)—Si grain boundary phase. For achieving effective coercivity enhancement, it is preferred that the volume percent of R—Fe(Co)—Si grain boundary phase be higher than the volume percent of R-rich phase. It is also preferred that the oxide phase, carbide phase and vacancies be as little as possible in the structure.

When Group IVa to VIa elements such as Ti, V, Zr, Nb, Mo, Hf, Ta and W are added, these elements tend to form compound phases with boron. The formation of such phases in the structure is acceptable if R element is not contained as constituent element therein as in the case of $TiB_2$, $ZrB_2$, NbFeB, $V_2FeB_2$, and $MO_2FeB_2$ phases. However, the proportion of these phases is preferably 3 vol % or less in order to avoid a substantial loss of Br.

The inventive magnet having the above-defined structural construction has excellent magnetic properties, in particular a coercive force iHc of at least 10 kOe, and preferably a remanence Br of at least 10 kG, more preferably at least 12 kG. A higher iHc is obtainable when Dy and/or Tb is contained as part of R. The magnet containing Dy and/or Tb as part of R exhibits a coercive force iHc of at least (10+5×D) kOe wherein D is the total concentration (atom percent) of Dy and Tb in the magnet. This indicates a significant increase of iHc value over the prior art R—Fe—B base magnets having the same amount of Dy and Tb added.

The magnet of the invention is manufactured by first high-frequency melting source ingredients in vacuum or in an inert gas such as argon to form a starting alloy of the desired composition. This may be done by conventional melt casting or strip casting.

The starting alloy thus obtained is roughly ground by mechanical grinding or hydrogenation-assisted grinding and then comminuted by jet milling into an alloy powder having an average particle size of about 1 to 10 μm. Alternatively, several alloy powders of different compositions are mixed so as to give an alloy powder having an average composition within the desired range.

The alloy powder thus obtained is oriented and compacted in a magnetic field, and sintered. For further enhancement of magnetic properties, the powder may be processed in a non-oxidizing atmosphere. Sintering is preferably carried out in vacuum or in an inert atmosphere such as argon at a temperature of 1,000 to 1,200° C. for about 1 to 5 hours. The sintering is followed by cooling. Better results are obtained through cooling at a controlled rate. Specifically, the compact as sintered is slowly cooled at a rate of 0.1 to 5° C./min at least in a temperature range from 700° C. to 500° C., or cooled in multiple stages including holding at a constant temperature for at least 30 minutes on the way of cooling. In an alternative process, the sintered body is heated again in vacuum or in an inert atmosphere such as argon at a temperature of at least 700° C., preferably 800 to 1,000° C. and then cooled similarly (i.e., slow cooling or multi-stage cooling). If the sintered compact is allowed to cool or rapidly cooled at a rate of more than 5° C./min, then the R—Fe(Co)—Si grain boundary phase is not fully formed in the magnet structure, even with the same composition, and an R—Si compound phase often exists concomitantly. In such cases, a satisfactory coercive force is not available. The controlledly cooled material may be subjected to further heat treatment at 400 to 550° C. for coercive force enhancement.

EXAMPLE

Examples of the invention are given below by way of illustration and not by way of limitation.

Examples 1–8 and Comparative Examples 1–6

Nd, Pr, Dy, Tb, Fe, Co, Si, other metals, and ferroboron alloy were weighed so as to give a predetermined composition. They were melted in an argon atmosphere by high-frequency induction heating and cast into a starting alloy. The alloy was solid-solution treated at 1050° C. for 10 hours and mechanically ground into a coarse powder. The alloy powder was comminuted on a jet mill. The powder comminuted had an average particle size within the range of 3 to 7 μm. The powder was pressed into a compact while being oriented in a magnetic field of 10 kOe. The compact was sintered at 1100° C. for 2 hours. After sintering, samples were cooled in three different patterns.

In Pattern A, sintering was directly followed by cooling at a predetermined rate down to 400° C.

In Pattern B, sintering was followed by furnace cooling to room temperature, after which the sample was heated again at 950° C., held at the temperature for one hour, and then cooled at a predetermined rate down to 400° C.

In Pattern C, sintering was followed by multi-stage cooling including staged temperature holding.

The magnetic properties of the samples were measured by means of a BH tracer. A portion of the sample was polished and subjected to structure observation and quantitative analysis by EPMA. With respect to the composition ratio of respective phases, the area percent on the observed surface was directly used as the volume percent.

Table 1 shows the composition, post-sintering cooling pattern, and magnetic properties of samples. Table 2 shows the results of quantitative analysis of R—Fe(Co)—Si grain boundary phase and the volume percents of primary phase, R-rich phase and R—Fe(Co)—Si grain boundary phase (which do not sum to 100% because oxide and other phases are included as well).

On observation by EPMA, the B-rich phase and R—Si compound phase were not found in Examples 1 to 8. In Examples 6 and 7, compound phases containing the additive element and boron were found, but these compound phases did not contain any R element.

In Comparative Examples 1 to 3, the R—FeCo—Si grain boundary phase was not found in the structure. The sample of Comparative Example 4 had a Br of less than 10 kG and contained the R—Si compound phase together with the R—FeCo—Si grain boundary phase. The sample of Comparative Example 5 in which R was Nd alone had an iHc of less than 10 kOe. In Comparative Example 6, the comminuted powder could not be processed further because it ignited and burned prior to compaction.

TABLE 1

| | Composition (atomic ratio) | Cooling pattern | | Magnetic properties | |
|---|---|---|---|---|---|
| | | Pattern | Control | Br (kG) | iHc (kOe) |
| Example | | | | | |
| 1 | $Nd_{8.4}Pr_{5.6}Fe_{bal.}Si_{0.4}B_{5.6}$ | A | 0.4° C./min | 13.6 | 12.6 |
| 2 | $Nd_{9.0}Pr_{6.0}Fe_{bal.}Co_{3.7}Si_{0.5}B_{5.4}$ | A | 1.7° C./min | 13.3 | 15.0 |
| 3 | $Nd_{11.3}Pr_{3.3}Dy_{0.8}Fe_{bal.}Co_{4.5}Si_{1.8}B_{5.3}$ | B | 1.1° C./min | 12.7 | 19.3 |
| 4 | $Nd_{7.0}Pr_{4.4}Dy_{2.0}Tb_{1.0}Fe_{bal.}Co_{5.6}Si_{1.2}B_{5.2}$ | B | 1.7° C./min | 11.6 | 32.7 |
| 5 | $Nd_{11.4}Pr_{3.4}Dy_{0.5}Fe_{bal.}Co_{4.0}Si_{1.2}B_{5.3}Al_{1.0}$ | A | 1.1° C./min | 12.4 | 19.8 |
| 6 | $Nd_{12.0}Pr_{3.0}Dy_{1.0}Fe_{bal.}Co_{2.0}Si_{2.5}B_{5.3}Ti_{0.1}$ | A | 4° C./min | 12.0 | 18.3 |
| 7 | $Nd_{10.6}Pr_{3.2}Dy_{0.6}Fe_{bal.}Si_{0.9}B_{5.8}V_{0.4}$ | C | 750° C. × 1 h + 550° C. × 1 h + 400° C. × 1 h | 13.1 | 15.2 |
| 8 | $Nd_{11.7}Pr_{2.6}Tb_{0.9}Fe_{bal.}Co_{3.8}Si_{1.0}B_{5.4}Cu_{0.2}$ | A | 1.7° C./min | 12.7 | 18.5 |
| Comparative Example | | | | | |
| 1 | $Nd_{11.5}Pr_{3.3}Dy_{0.8}Fe_{bal.}Co_{4.4}B_{5.3}$ | A | 0.4° C./min | 13.0 | 4.8 |
| 2 | $Nd_{0.8}Pr_{6.0}Fe_{bal.}Co_{3.0}Si_{0.4}B_{5.4}$ | — | furnace cooling | 13.4 | 9.2 |
| 3 | $Nd_{14.0}Dy_{0.7}Fe_{bal.}Co_{3.0}Al_{1.0}B_{6.5}$ | A | 2° C./min | 13.2 | 13.0 |
| 4 | $Nd_{12.4}Pr_{3.5}Dy_{0.9}Fe_{bal.}Co_{1.0}Si_{3.5}B_{5.1}$ | B | 0.5° C./min | 9.8 | 14.0 |
| 5 | $Nd_{14.0}Fe_{bal.}Si_{1.5}B_{5.2}$ | B | 2° C./min | 13.6 | 7.0 |
| 6 | $Pr_{17.0}Fe_{bal.}Si_{0.6}B_{5.6}$ | powder ignited and burned after comminution | | | |

TABLE 2

| | R—Fe(Co)—Si grain boundary phase composition (atomic ratio) | Constituent phases (vol %) | | |
|---|---|---|---|---|
| | | Primary phase | R-rich phase | R—Fe(Co)—Si grain boundary phase |
| Example | | | | |
| 1 | $Nd_{17.3}Pr_{11.5}Fe_{bal.}Si_{5.4}$ | 90.0 | 2.0 | 2.6 |
| 2 | $Nd_{18.1}Pr_{12.3}Fe_{bal.}Co_{2.9}Si_{5.6}$ | 84.5 | 2.5 | 5.1 |
| 3 | $Nd_{24.9}Pr_{7.3}Dy_{0.4}Fe_{bal.}Co_{3.4}Si_{5.3}$ | 82.1 | 2.6 | 6.5 |
| 4 | $Nd_{17.0}Pr_{10.8}Dy_{0.3}Tb_{0.1}Fe_{bal.}Co_{3.8}Si_{5.1}$ | 82.6 | <1.0 | 10.1 |
| 5 | $Nd_{23.2}Pr_{6.9}Dy_{0.4}Fe_{bal.}Co_{3.2}Si_{5.5}Al_{1.5}$ | 81.4 | 3.0 | 6.0 |
| 6 | $Nd_{27.3}Pr_{6.0}Dy_{0.3}Fe_{bal.}Co_{1.8}Si_{5.9}$ | 81.9 | 2.0 | 2.5 |
| 7 | $Nd_{22.1}Pr_{7.0}Dy_{0.3}Fe_{bal.}Si_{4.7}$ | 89.1 | <1.0 | 1.5 |
| 8 | $Nd_{22.3}Pr_{5.0}Tb_{0.3}Fe_{bal.}Co_{3.2}Si_{5.4}Cu_{0.2}$ | 84.1 | 2.7 | 4.8 |
| Comparative Example | | | | |
| 1 | no F—FeCo—Si grain boundary phase | | | |
| 2 | | | | |
| 3 | | | | |
| 4 | $Nd_{22.9}Pr_{6.3}Dy_{0.3}Fe_{bal.}Co_{0.9}Si_{5.1}$ | | R—Si compound phase | |
| 5 | $Nd_{28.7}Fe_{bal.}Si_{5.5}$ | | | |
| 6 | | | | |

Example 9

An alloy of the composition (in atom percent) of 10% Nd, 3.5% Pr, 1% Co, 1% Al, 5.6% B and the balance Fe was prepared by strip casting. Another alloy of the composition (in atom percent) of 15% Nd, 10% Dy, 30% Co, 1% Al, 8% Si and the balance Fe was prepared by high-frequency melting in an argon atmosphere. These two alloys were separately ground and mixed together in a weight ratio of 90:10, and then comminuted on a jet mill. The comminuted powder had an average particle size of 5.5 μm. The powder was pressed into a compact while being oriented in a magnetic field of 10 kOe. The compact was sintered at 1100° C. for 2 hours and then cooled at a rate of 3° C./min to 350° C.

The sample was measured by means of a BH tracer, finding Br 12.9 kG and iHc 17.0 kOe.

A portion of the sample was polished and subjected to structure observation by EPMA. The B-rich phase and R—Si compound phase were not found. The primary phase, R-rich phase and R—FeCo—Si phase were present in a proportion of 87.3%, 2.2% and 3.8%, respectively. The R—FeCo—Si phase had the composition (in atom percent) of 20.9% Nd, 6.4% Pr, 0.3% Dy, 2.9% Co, 1.8% Al, 5.1% Si and the balance Fe. The primary phase had a Si content of 0.9 at %.

There has been described an R—Fe—B base sintered magnet having the structure that contains a $R_2(Fe,(Co),Si)_{14}B$ primary phase and an R—Fe(Co)—Si grain boundary phase and is free of a B-rich phase, whereby the magnet exhibits a coercive force of 10 kOe or higher. The content of heavy rare earth can be reduced, as compared with prior art magnets.

Japanese Patent Application No. 2002-330741 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An R—Fe—B base sintered magnet of a composition consisting essentially of, in atom percent, 12 to 17% of R which stands for at least two of yttrium and rare earth elements and essentially contains Nd and Pr, 0.1 to 3% of Si, 5 to 5.9% of B, up to 10% of Co, and the balance of Fe, containing a primary phase of $R_2(Fe,(Co),Si)_{14}B$ intermetallic compound, and having a coercive force iHc of at least 10 kOe, characterized in that the magnet is free of a B-rich phase and contains at least 1% by volume based on the entire magnet of an R—Fe(Co)—Si grain boundary phase consisting essentially of, in atom percent, 25 to 35% of R, 2 to 8% of Si, up to 8% of Co, and the balance of Fe.

2. The sintered magnet of claim 1 which contains an R-rich phase, the volume percent of the R—Fe(Co)—Si grain boundary phase being higher than the volume percent of the R-rich phase.

3. The sintered magnet of claim 1 wherein an R—Si compound phase is absent in the magnet structure.

4. The sintered magnet of claim 1 wherein Dy and/or Tb is contained as part of R, and the coercive force iHc of the magnet is at least (10+5×D) kOe wherein D is the total concentration (atom percent) of Dy and Tb in the magnet.

5. The sintered magnet of claim 1 wherein the magnet is prepared by the steps of sintering and optional heat treatment, and the sintering or the heat treatment involves a cooling step of cooling at a controlled rate of 0.1 to 5° C./min at least in a temperature range from 700° C. to 500° C., or a multi-stage cooling step including holding at a constant temperature for at least 30 minutes on the way of cooling whereby the R—Fe(Co)—Si grain boundary phase is formed in the magnet structure.

* * * * *